US007713178B2

(12) United States Patent
Edmondson

(10) Patent No.: US 7,713,178 B2
(45) Date of Patent: May 11, 2010

(54) SKATING SIMULATION EXERCISE DEVICE

(76) Inventor: Robert Edmondson, 391 Walton St., Peterborough, Ontario K9H 4S9 (CA)

( * ) Notice: Subject to any disclaimer, the term of this patent is extended or adjusted under 35 U.S.C. 154(b) by 219 days.

(21) Appl. No.: 11/840,370

(22) Filed: Aug. 17, 2007

(65) Prior Publication Data

US 2008/0045386 A1 Feb. 21, 2008

Related U.S. Application Data

(60) Provisional application No. 60/838,109, filed on Aug. 17, 2006.

(51) Int. Cl.
*A63B 22/00* (2006.01)

(52) U.S. Cl. ..... 482/70; 482/110; 482/121

(58) Field of Classification Search ..... 482/70
See application file for complete search history.

(56) References Cited

U.S. PATENT DOCUMENTS

| | | | | | |
|---|---|---|---|---|---|
| 3,756,595 | A * | 9/1973 | Hague | 482/51 |
| 4,340,214 | A * | 7/1982 | Schutzer | 482/51 |
| 4,915,373 | A * | 4/1990 | Walker | 482/51 |
| 5,230,676 | A * | 7/1993 | Terauds | 482/53 |
| 5,284,460 | A * | 2/1994 | Miller et al. | 482/51 |
| 5,304,106 | A * | 4/1994 | Gresko | 482/53 |
| 5,328,427 | A * | 7/1994 | Sleamaker | 482/71 |
| 5,391,130 | A * | 2/1995 | Green et al. | 482/71 |
| 5,433,683 | A * | 7/1995 | Stevens | 482/70 |
| 5,718,658 | A * | 2/1998 | Miller et al. | 482/71 |
| 5,800,313 | A * | 9/1998 | Yu | 482/53 |
| 5,910,072 | A * | 6/1999 | Rawls et al. | 482/51 |
| 6,036,622 | A * | 3/2000 | Gordon | 482/51 |
| 6,234,935 | B1 * | 5/2001 | Chu | 482/51 |
| 6,340,340 | B1 * | 1/2002 | Stearns et al. | 482/52 |
| 6,514,180 | B1 * | 2/2003 | Rawls | 482/70 |
| 6,569,041 | B1 * | 5/2003 | Riivald | 473/446 |
| 6,695,749 | B2 * | 2/2004 | Kuo | 482/53 |
| 6,786,850 | B2 | 9/2004 | Nizamuddin | 482/51 |
| 6,849,032 | B2 | 2/2005 | Chu | 482/51 |
| 7,014,595 | B2 * | 3/2006 | Bruno | 482/51 |
| 7,115,073 | B2 * | 10/2006 | Nizamuddin | 482/51 |
| 7,226,390 | B2 * | 6/2007 | Stearns | 482/52 |
| 7,338,414 | B1 * | 3/2008 | Hsiung | 482/71 |
| 7,473,210 | B1 * | 1/2009 | Hsiung | 482/51 |
| 2002/0042329 | A1 * | 4/2002 | Nizamuddin | 482/51 |
| 2004/0241631 | A1 * | 12/2004 | Nizamuddin | 434/253 |
| 2005/0009668 | A1 * | 1/2005 | Savettiere et al. | 482/66 |
| 2005/0014613 | A1 * | 1/2005 | Chu | 482/79 |
| 2005/0079956 | A1 * | 4/2005 | Bruno | 482/51 |
| 2005/0124466 | A1 * | 6/2005 | Rodgers, Jr. | 482/52 |
| 2005/0266964 | A1 * | 12/2005 | Teng | 482/71 |
| 2006/0211544 | A1 * | 9/2006 | Loane | 482/70 |
| 2006/0287168 | A1 * | 12/2006 | Nizam | 482/71 |
| 2009/0239713 | A1 * | 9/2009 | Chu | 482/51 |

* cited by examiner

*Primary Examiner*—Steve R Crow
*Assistant Examiner*—Robert F Long
(74) *Attorney, Agent, or Firm*—Teitelbaum & MacLean; Neil Teitelbaum; Doug MacLean

(57) ABSTRACT

The invention relates to a skating simulating exercise device including a force transmission means, which exponentially increases the amount of force required to spin a flywheel as the user approaches the limits of ovoid shaped boundaries, thereby eliminating abrupt stoppages and to simulate the digging in and pushing off actions in a real skating stride. The skating simulating exercise device also includes resistance to both rearward and lateral motion, which can be linked together to more effectively strengthen all aspects of a skater's motion.

20 Claims, 12 Drawing Sheets

SKATING SIMULATION EXERCISE DEVICE

CROSS-REFERENCE TO RELATED APPLICATIONS

The present invention claims priority from U.S. Patent Application No. 60/838,109 filed Aug. 17, 2006, which is incorporated herein by reference for all purposes.

TECHNICAL FIELD

The present invention relates to an skating simulation exercise device, and in particular to a skating simulation exercise device, which accurately simulates both rearward and lateral aspects of the skating stride.

BACKGROUND OF THE INVENTION

Conventional training devices, which attempt to simulate the skating stride, such as those disclosed in U.S. Pat. No. 3,756,595 issued Sep. 4, 1973 to Hague; U.S. Pat. No. 5,284,460 issued Feb. 8, 1994 to Miller et al; and U.S. Pat. No. 6,849,032 issued Feb. 1, 2005 to Chu, require that the user is standing on the ends of rotating arms, which define a set and limited range of motion.

Inertia and wind are the two primary elements of resistance in actual skating. It is not enough to simply replicate the mechanics of skating, a true skating machine must also have the feel of skating, which is only obtained by incorporating inertial resistance. Machines that employ weight stacks, hydraulic pistons or elastic cords for resistance lack this important inertial component. Regardless of how energetic the user's efforts on conventional machines each stroke will feel the same as the last, and there will never be any sense of building momentum, as in real skating.

Alternative systems, such as those disclosed in U.S. Pat. No. 4,915,373 issued Apr. 10, 1990 to Walker; U.S. Pat. No. 6,786,850 issued Sep. 7, 2004 to Nizamuddin; and U.S. Pat. No. 7,014,595 issued Mar. 21, 2006 to Bruno, utilized tracks to define the range of motion of the user.

Unfortunately, the user's skating stride, i.e. their stride path geometry, is defined by both rearward and lateral components, and does not always match that of the training device, therefore the user, while still exercising, is not strengthening their own skating stride when utilizing the above-identified training devices.

World Patent Application No. WO2004/108229 published Dec. 16, 2004 in the name of Jadine discloses inline roller skates secured to the ends of cords, which are engaged with a flywheel, thereby enabling the user to practice his own skating stride. Unfortunately, the Janine device is totally free wheeling with no provision for an increasing gradient of resistance at either the end of the stride or at the outer limit of lateral motion so as to contain the user's stride path within a defined area and thereby prevent the user from losing control.

An object of the present invention is to overcome the shortcomings of the prior art by providing a skating simulating exercise device, which enables the user to strengthen their own skating stride by providing an infinitely variable stride path geometry dictated by the user, which is contained within certain boundaries to ensure balance.

SUMMARY OF THE INVENTION

Accordingly, the present invention relates to a skating simulating exercise device comprising:

a frame;

a resistance apparatus supported by the frame;

first and second moveable foot supports for supporting a user's feet during forward and rearward movement;

first and second pull cables fixed at first ends thereof to the first and second moveable foot supports, respectively, and to the frame at second ends; and first and second force transmission means interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus, while exponentially increasing the amount of force transmitted to the frame.

BRIEF DESCRIPTION OF THE DRAWINGS

The invention will be described in greater detail with reference to the accompanying drawings which represent preferred embodiments thereof, wherein.

DETAILED DESCRIPTION

Figure 1A:
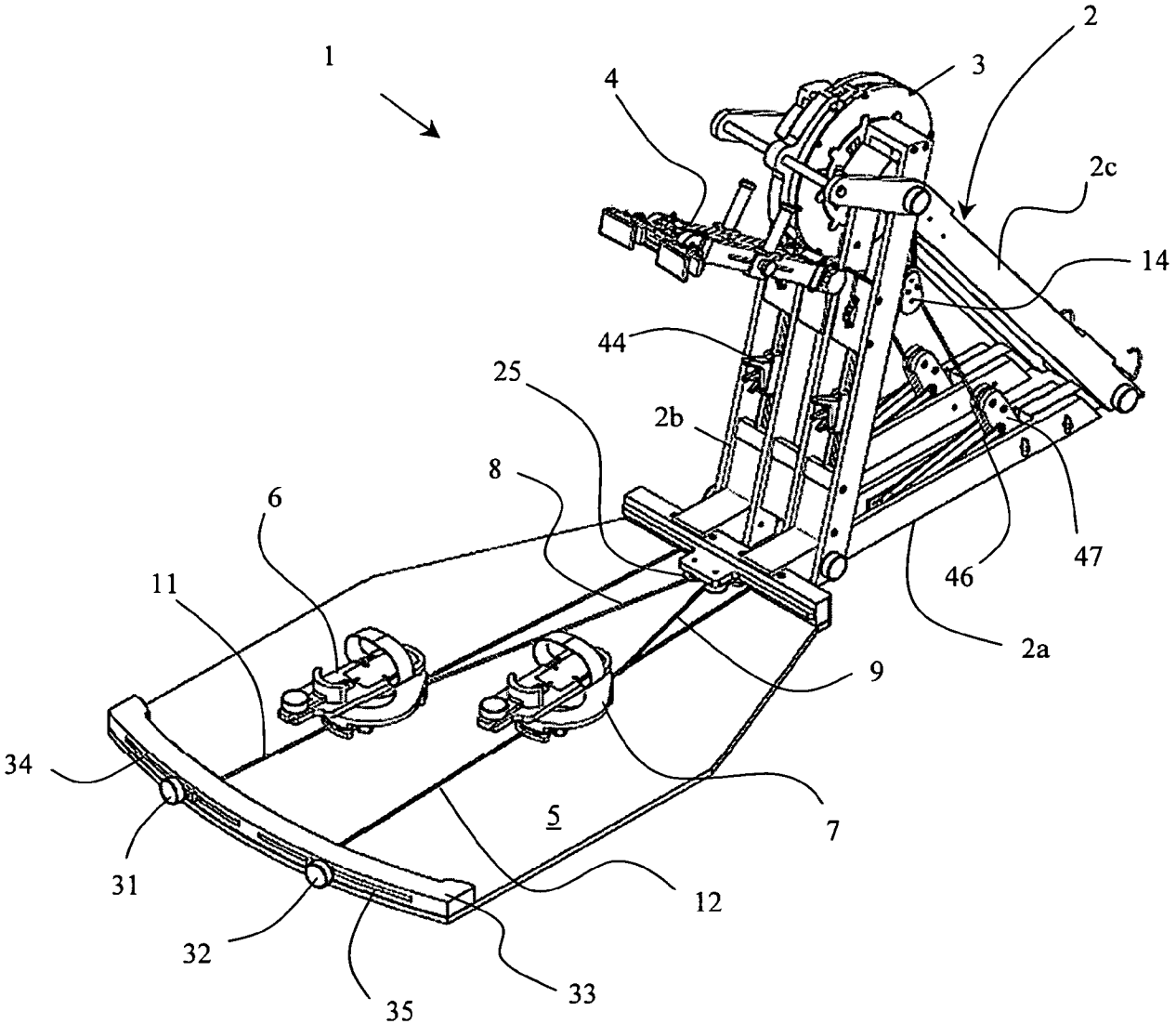
FIG. 1*a* is an isometric view of the skating simulation exercise device of the present invention.
Figure 1B:
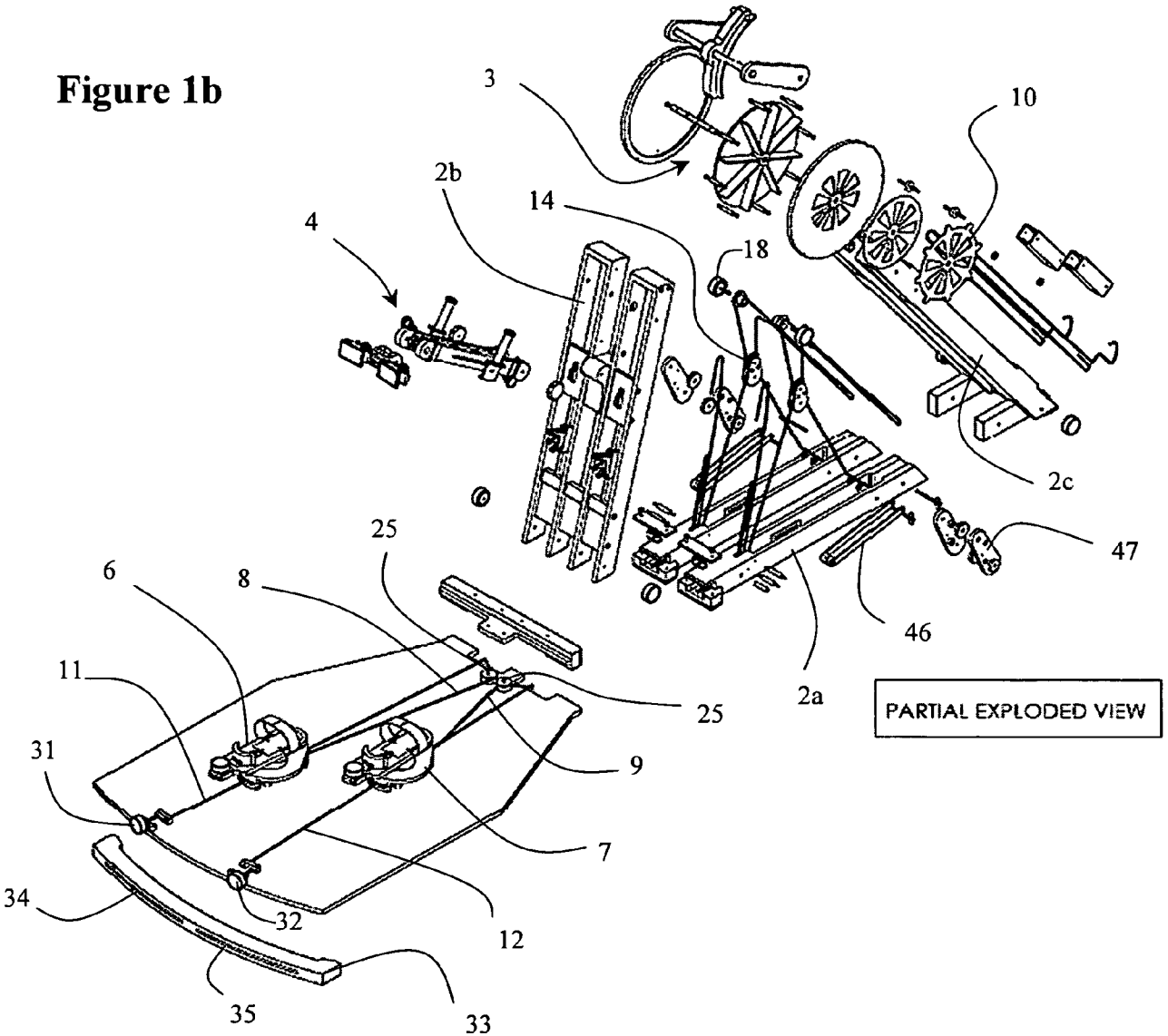
FIG. 1*b* is an exploded view of the device of FIG. 1.

With reference to FIGS. 1*a* and 1*b*, the skating simulation exercising device 1, according to the present invention, includes a triangular frame 2 for mounting an inertial resistance apparatus, e.g. a flywheel 3, and an optional torso-supporting arm 4. Typically a smooth skating surface 5 is provided, which extends from the base of the frame 2, but an existing surface can be used, if the device 1 is permanently set up proximate a suitably smooth surface. Left and right sliding foot supports 6 and 7 are connected on the ends of left and right pull cables 8 and 9, respectively, and laterally confined by left and right guide cables 11 and 12, respectively. The resistance of the flywheel 3 can be adjusted by the rotation of vent covers 10, which regulate the amount of air that is passed through the vanes of the flywheel 3. The use of the flywheel 3 enables the user to stride until the flywheel 3 reaches a certain speed, i.e. revolutions per minute, pause for a period of time, i.e. simulating gliding, while the flywheel 3 continues to rotate, and then continue striding with a certain amount of force that does not feel like starting from a dead stop, as with most exercising machines.

Ideally the frame 2 is triangular including an opened framed base 2*a*, an opened framed front leg 2*b* extending at an acute angle to the base 2*a*, and an opened framed rear leg 2*c*, extending at an acute angle from both the base 2*a* and the front leg 2*b*.

Although the resistance provided by the flywheel 3 is ideally suited for a skating simulating exercise device, connecting the flywheel 3 directly to the left and right foot supports 6 and 7 does not provide the user with the realistic sensation of digging in and pushing off with one foot while bringing the other foot forward to begin the next stride.

Figure 2:
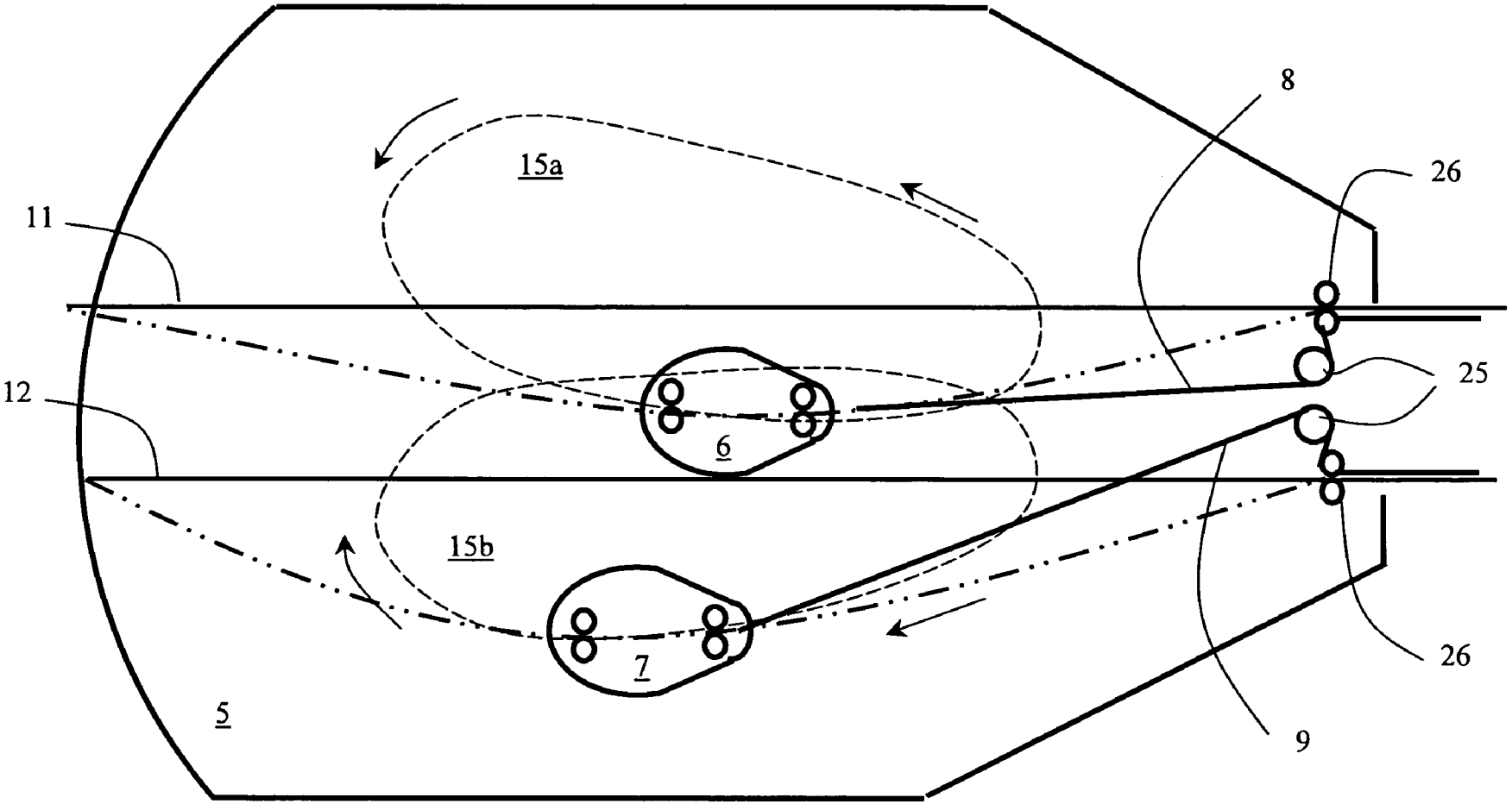
FIG. 2 is a plan view of the skating surface of the device of FIG. 1.

With no boundaries to define and contain the range of lateral and rearward movement, the balance and control of the user is seriously compromised. Accordingly, the present invention provides a pull and guide cable system, which defines the boundaries of the skating stride of the left and right feet. With reference to FIG. 2, the two areas 15*a* and 15*b* defined by these boundaries are approximately ovoid in shape, with the broader curved end of each ovoid rearward of the user, accurately replicating the areas traversed by the feet during actual skating. The pull and guide cable systems provide an increasing gradient, e.g. exponential increase, of resistance at any point of approach of the user's feet to the boundaries of the defined areas 15*a* and 15*b*, providing a firm, but resilient containment of the user's stride within the defined areas.

Within the ovoid areas 15*a* and 15*b* defined by the pull and guide cable systems, the user's movement is not restricted to the skating stride, whereby during the power portion of the stride, the feet push in an arc back and to the side, and then return up the middle, as shown by arrows in FIG. 2. The freedom of movement provided by the present invention with the defined areas also enables the user to push straight back down the middle with the return portion of the stride to the outside, which is an alternative stride not like a skating stride, but is an equally viable exercise, i.e. in opposite direction to arrows in FIG. 2. Accordingly, the present invention offers an infinitely variable stride path geometry to the user, along with directional freedom of movement.

Figure 3A:
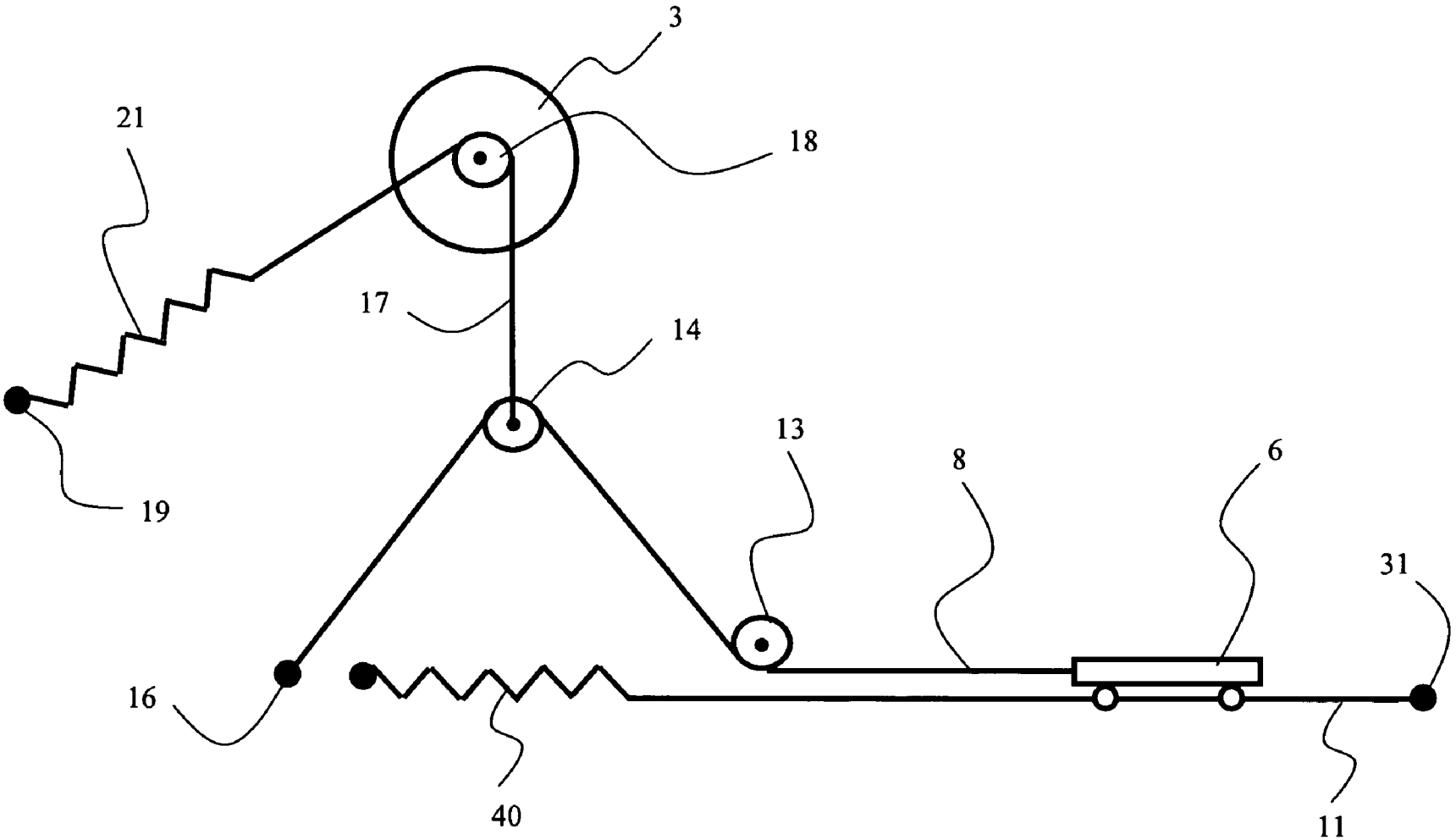
FIG. 3*a* is a side view of a basic pull cable and guide cable arrangements of the device of FIG. 1.
Figure 3B:
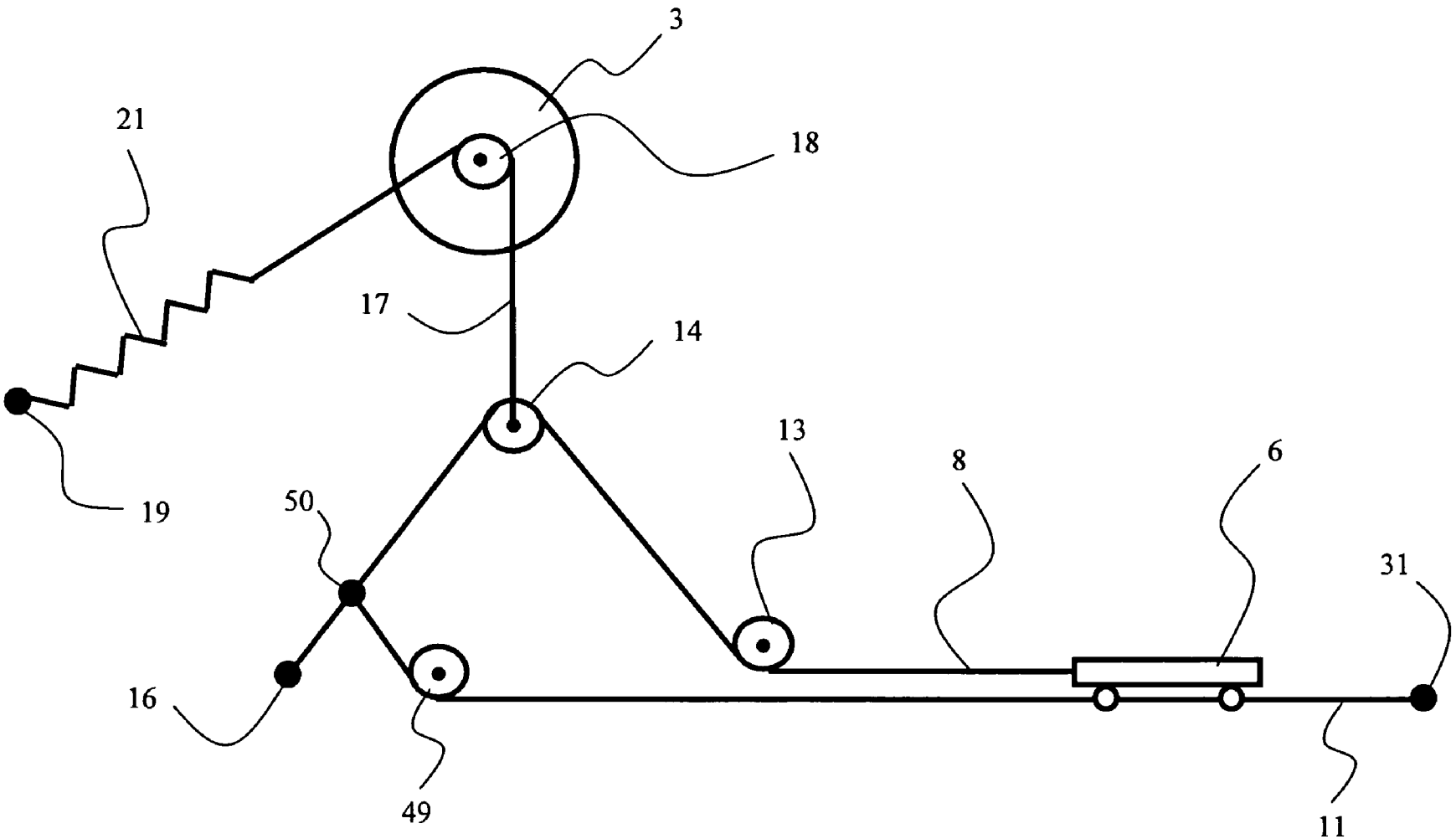
FIG. 3*b* is a side view of an alternative pull cable and guide cable arrangements of the device of FIG. 1.

The basic principle of the pull cable system is illustrated in FIGS. 3*a* and 3*b*, in which each pull cable (only left pull cable 8 shown) is passes under a fixed roller 13, has a bend formed therein by being passed over a reciprocating pulley 14, and directed to a fixed point 16, whereby the fixed roller 13, the reciprocating pulley 14 and the fixed point 16 form the vertices of a triangle. The fixed point 16 can be the end of the pull cable 8 or 9, or a point through which the pull cable 8 or 9 passes over before being fixed to the frame 2. A motion converting chain 17 is connected to the reciprocating pulley 14, and extends around a sprocket 18, which is connected to an axle of the flywheel 3. The other end of the chain 17 is fixed at a point 19 via a return spring/elastic 21.

During use, ignoring the effect of lateral motion, rearward motion of the left foot support 6 pulls on the left pull cable 8, which forces the pulley 14 to move downwardly, decreasing the size of the triangle until the left pull cable 8 is substantially straight, with the pulley 14 in alignment between the fixed roller 13 and the fixed point 16. As the pulley 14 moves downwardly, the mechanical advantage of the left pull cable 8 on the pulley 14 decreases exponentially, and the force required to move the left foot support 6 follows an increasing gradient e.g. exponentially increases, until a point limited by the strength of the left pull cable 8, in which the left pull cable 8 is substantially pulling directly on the frame 2, e.g. via fixed point 16. As the pulley 14 moves downwardly, the chain 17 rotates the sprocket 18, thereby rotating the flywheel 3 and transferring the rearward motion of the left foot support 6 to the flywheel 3, i.e. the flywheel 3 provides resistance to rearward movement. The return spring 21 biases the pulley 14 back into the raised position as the left foot support 6 is returned to the forward position. The sprocket 18 is mounted on a roller clutch enabling force to be applied to the flywheel 3 while the left cable 8 is being pulled rearward, but enabling the sprocket 18 to freewheel when the left cable 8 is returning to the forward position. The identical mechanisms are provided and the identical processes are repeated as the right foot support 7 is moved rearward pulling on the right pull cable 9.

In the basic embodiment illustrated in FIG. 3*a*, the left and right guide cables 11 and 12 have only some elasticity or spring biasing 40, e.g. bungee cord, forcing them back to a rest position, with the ends thereof fixed to the frame 2. If low tension, high elasticity spring cables are used for both the pull and guide cables 8, 9, 11, and 12, the aforementioned alternative stride style would result, which is enhanced by the lack of lateral movement restraint.

In the alternate embodiment, illustrated in FIG. 3*b*, the left and right guide cables 11 and 12 travel around a pulley 49 to a mechanical linkage 50 on the left pull cable 8, whereby lateral displacement of the left foot support 6 applies a pulling force on the left guide cable 11, which applies a pulling force on the left pull cable 8 via the mechanical linkage 50. Accordingly, the pulling force on the left pull cable 8 translates the pulley 14 downwardly applying a portion of the pulling force to the flywheel 3 via the chain 17, but at the same time decreasing the mechanical advantage of the left pull cable 8 on the pulley 14. As above, both the rearward and lateral motion of the left and right foot supports 6 and 7 apply force to the flywheel 3, and provide the gradually increasing gradient, e.g. exponentially increase, of resistance.

FIG. 3*b* illustrates a more advanced principle, in which the force of lateral motion is imparted to the flywheel 3 through the connection and interaction of each guide cable 11 and 12 with its associated pull cable 8 and 9, respectively, as hereinafter discussed. Identical principles are at work in both stride length, i.e. rearward, control and range of lateral motion control. Just as pull cable 8 defines a triangle with vertices at fixed point 16, reciprocating pulley 14, and the fixed roller 13, so too, guide cable 11 (controlling lateral motion) together with part of pull cable 8, defines a smaller triangle with vertices at fixed point 16, cable link point 50, and fixed roller 49. The application of lateral force to left foot support 6, tensions guide cable 11, which results in a pulling downward of cable link point 50, tensioning pull cable 8, and thereby pulley 14, imparting the energy of that lateral movement to the flywheel 3.

Note that the smaller triangle undergoes the same leverage dynamics as a result of lateral movement of left foot support 6, as does the larger triangle as a result of rearward movement of the left foot support 6. As cable link point 50 is pulled down, the angular changes in the smaller triangle results in a decreasing, e.g. exponentially, mechanical advantage and consequently an increase in the gradient, e.g. an exponential increase, to the resistance of lateral motion. The increase in resistance to lateral movement reaches a zenith when cable link point 50 is pulled into alignment with fixed point 16 and fixed roller 49, at which point further lateral movement is not possible, without breaking the left guide cable 11, i.e. the left guide cable 111 is substantially pulling directly on the frame 2 via the fixed point 16.

Throughout the skating stride the two triangles continuously interact with each other in a complex interplay of forces. As described above, the applied lateral forces working on the small triangle (16, 49, 50) change the forces working on the large triangle (13, 14, 16). Conversely, changes in forces on the large triangle (caused by the inevitably varying magnitude of rearward force applied to foot support 6, as the user of the device 1 expends more or less energy), results in changes of applied forces on the small triangle, as well. For example, the greater the force with which left foot support 6 is driven rearward, the greater the tension on pull cable 8, which results in greater force being required to move cable link point 50 downward, which will in turn increase resistance to lateral motion, thereby augmenting the user's balance and control during high intensity workouts. These constantly changing mechanical interactions between the rearward and lateral force components add immeasurably to the fidelity of the skating stride.

Left guide cable 11 is under the least amount of tension at the end of the skating stride, at which time the reciprocating pulley 14 is substantially in alignment with the fixed point 16 and the fixed roller 13, whereby the tension on the left pull cable 8 no longer has any additive effect on the tension of the guide cable 11. The reduction of tension in the left guide cable 11, when the left pull cable 8 is at maximum extension, enables the user's stride path to follow a natural arc in the transition from the power portion of the skating stride to the return (or recovery) portion of the skating stride, thereby defining the broad rearward curve of one of the two ovoid shaped skating stride containment areas defined by the pull and guide cables 8, 9, 11 and 12.

Figure 4A:
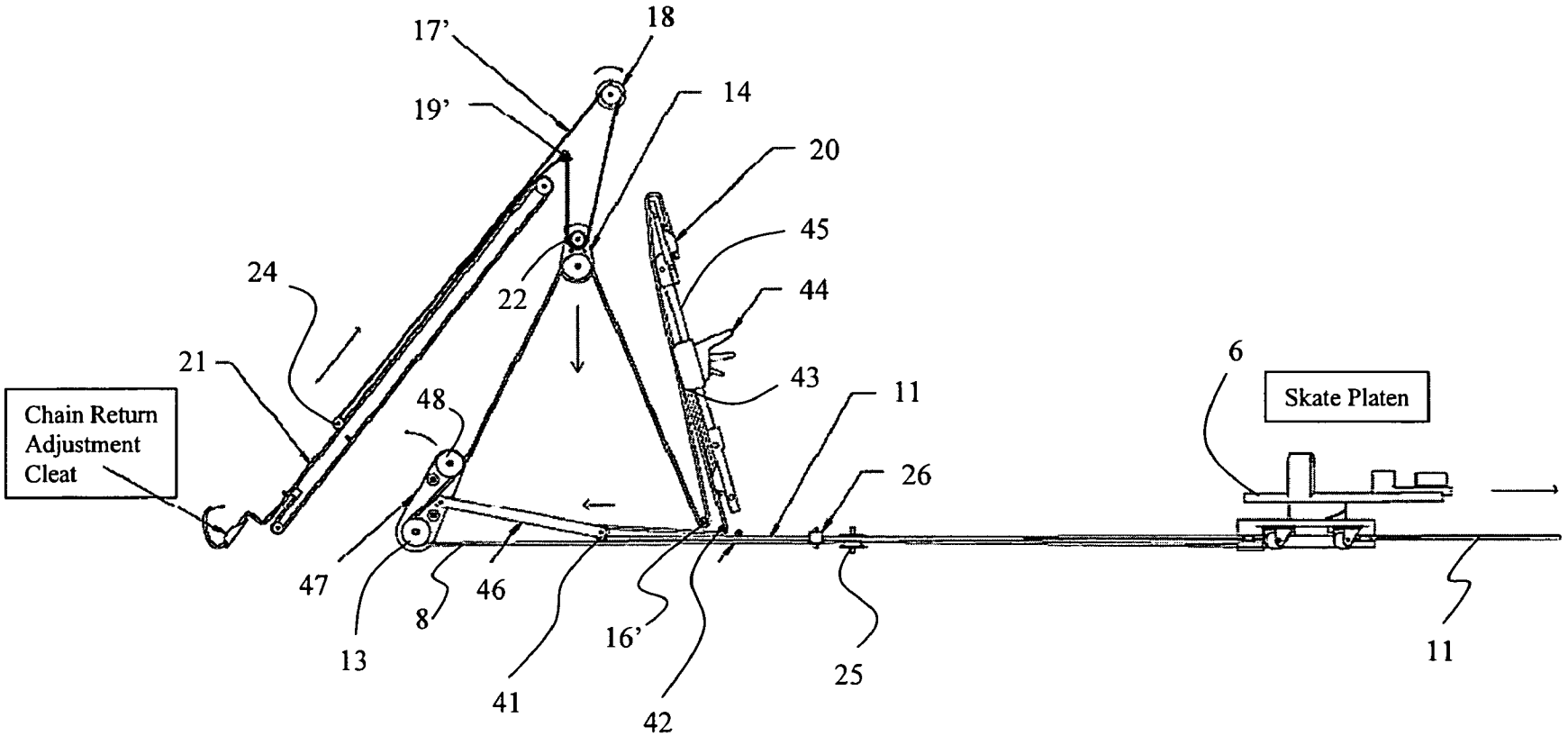
FIG. 4*a* is a side view of a preferred embodiment of the pull cable and guide cable arrangement of the device of FIG. 1.

A practical pull cable system is illustrated in FIG. 4, in which the fixed point 16 is provided by a roller 16', and in which the end of the left pull cable 8 is removeably fixed in a cleat 20 positioned on the front leg 2*b* of the frame 2 enabling easy access for adjusting the length of the left pull cable 8 for adjusting the stride length of the user. Moreover, the straight chain 17 is replaced by an endless chain 17', which loops around both the sprocket 18 and a second sprocket 22 mounted adjacent the reciprocating pulley 14, and is fixed at a point 19'. The looped endless chain 17' doubles the length of the chain 17 per stroke moving over the sprocket 18, thereby enabling a more effective RPM on the flywheel 3. Preferably, a loop of the endless chain 17' also passes over a sliding sprocket 24, sliding in the rear leg 2*c* of the frame 2, and connected to an end of the spring return 21, which is fixed on the back leg 2*c* of the frame 2. Passing the chain over the sliding sprocket 24 shortens the required elongation of the return spring 21, thereby increasing the longevity thereof.

The ends of the left and right guide cables 11 and 12, respectively, are fixed at spaced apart positions 31 and 32, respectively, to the rear of the users stride length on a rear bracket 33, which is either mounted on the surface 5 or on the permanent surface provided. The rear bracket 33 is provided with slots 34 and 35 enabling the positions 31 and 32 to be adjusted according to the width of the users stride. The left and right guide cables 11 and 12 pass through guides, e.g. front and back guide rollers 37 and 38, on the left and right foot supports 6 and 7. The left and right guide cables 11 and 12 keeps the base of the left and right foot supports 6 and 7 oriented towards the front of the device 1. A set of rollers 26 can be provided at the front of the frame 2 for guiding the left and right pull cables 8 and 9, and the left and right guide cables 11 and 12.

Offset pull cable wheels 25 direct the pull cables 8 and 9 at an acute angle to the guide cables 8 and 9, respectively, prior to passing through the rollers 26, which ensures immediate engagement of the flywheel 3 at the start of the rearward stride, when the lateral vector of the stride is greater than the rearward vector.

In the preferred and illustrated embodiment, lateral force on the left and right guide cables 11 and 12 also impart energy to, i.e. receive resistance from, the flywheel 3 by interacting with the aforementioned pull cable system. Accordingly, as illustrated in FIG. 4, the left guide cable 11 passes over a lever arm roller 41 back around a horizontal roller 42 up to an adjustable end point 43. In the illustrated embodiment, the end of the guide cable 11 is connected to a clamp 44 slidable on a rod 45, but other adjustment means are also possible to enable the width of the users stride to be adjusted. The lever arm roller 41 is mounted on a pull arm 46, which is pivotally connected to a lever 47, on which the fixed roller 13 and a force applying roller 48 are mounted, whereby when the user, via the left foot support 6, pushes out laterally on the left guide cable 11, the guide cable 11 pulls on the pull arm 46, which rotates the lever 47. Rotating the lever 47 causes the force applying roller 48 to apply a downward force on the left pull cable 8, which forces the pulley 14 downwardly, thereby rotating the flywheel 3, as described hereinabove. The mechanical linkage provided by the pull arm 46, the lever 47, and the force applying roller 48 multiplies the force on the guide cable 11, and ensures that any given magnitude of lateral motion of the left foot support 6 results in a greater downward movement of the reciprocating pulley 14 than would occur with the identical magnitude of lateral motion in the simplified embodiment of FIG. 3*b*. Accordingly, just as in actual skating in which both the rearward and lateral components of the user's skating stride will impart energy to the flywheel 3, i.e. will contribute to the flywheel's rotational inertia, thereby enhancing the simulation and exercise aspects of the device 1.

The harder the user drives the left and right foot supports 6 an 7 rearward, the greater the tension on the pull cables 8 and 9, which tends to rotate the lever 47 in a counter-clockwise direction, thereby pulling on the pull arm 46 and increasing the tension on the guide cables 11 and 12. The increased tension of the guide cables 11 and 12 helps to stabilize the user by preventing the user's feet from splaying out when accelerating.

The pull and guide cables 8, 9, 11 and 12 define the limits of movement of the left and right foot supports 6 and 7, whereby the magnitude of the rearward distance traveled by either the left or right foot support 6 or 7 is proportional to the distance the reciprocating pulley 14 moves between the upper and lower positions, and the magnitude of the lateral distance traveled by either the left or right foot support 6 or 7 is directly proportional to the distance the cable link point 50, e.g. force applying roller 48, moves between the upper and lower positions. Accordingly, the pull and guide cables 8, 9, 11 and 12 have an adjustable length to provide each user with appropriate limits of movement.

Figure 4B:
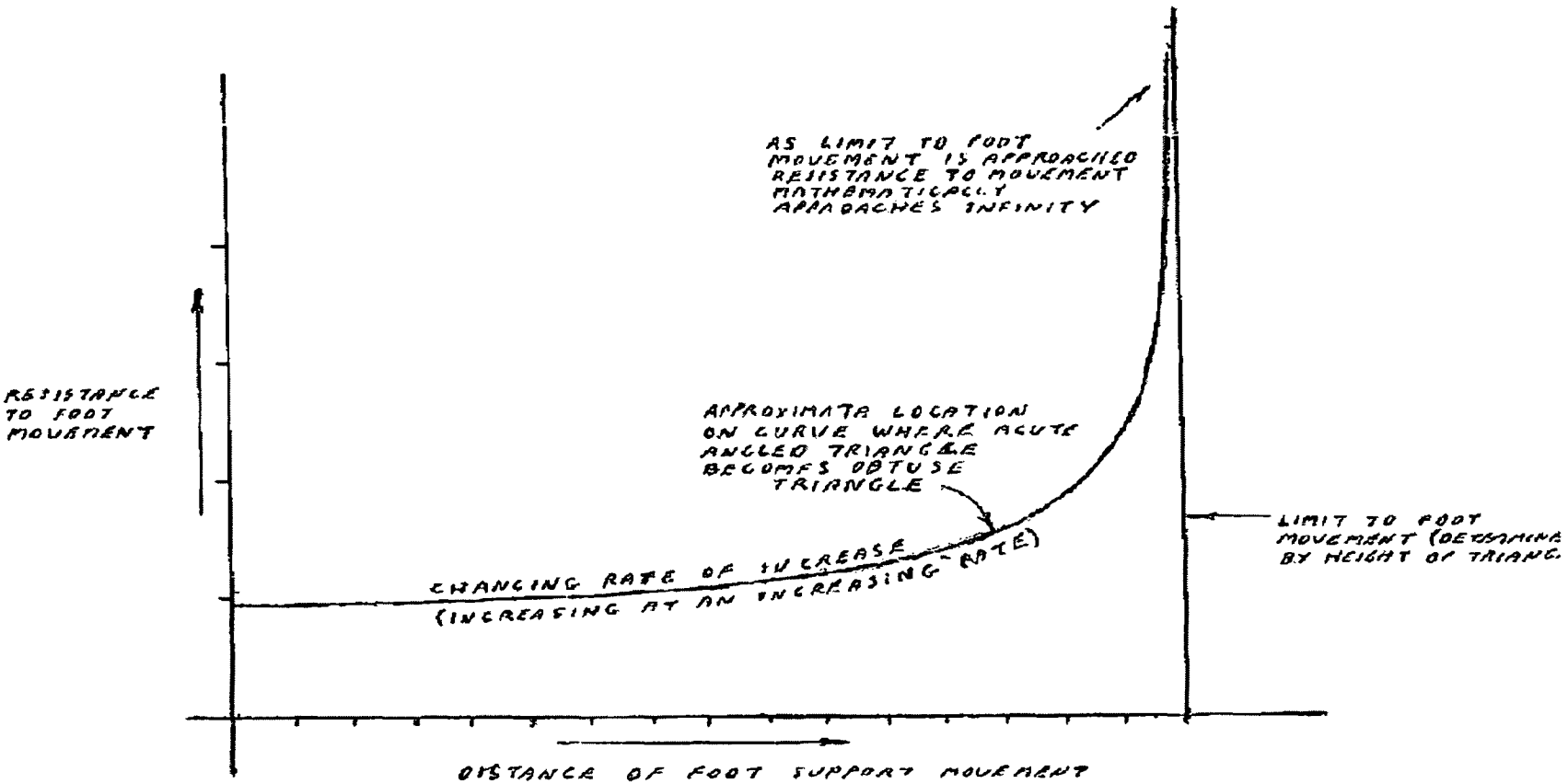
FIG. 4*b* is a plot of resistance to foot movement vs. distance of foot movement of the device of FIG. 1.

As illustrated in FIG. 4*b*, as the height of the first (or second smaller) triangle 13, 14, 16 (or 13, 49, 50) decreases to zero, the force transmitted to the reciprocating pulley 14 decreases at an exponential rate to approximately zero, and the force transmitted to the frame 2 increases at an exponential rate until approximately equal to the total force applied by the user. Accordingly, the resistance to movement of the foot supports 6 and 7 in the rearward or lateral directions (or any combination thereof) increase at an exponential rate.

The adjustable limits to movement are more accurately described as adjustments to the size, geometry, and juxtaposition of the substantially ovoid shaped areas in which the user's right and left foot movements are confined. The length of the left and right ovoid areas can be adjusted by adjusting the length of the left and right pull cables 8 and 9. The width of the left and right ovoid areas can be adjusted by adjusting the length of the left and right guide cables 11 and 12. The adjustment of the left and right guide cables 11 and 12 will also affect the amount of central overlap of the two ovoid areas. The degree of angular displacement between the central longitudinal lines of the two ovoid areas can be adjusted by changing the positions of the end positions 31 and 32 of the left and right guide cables 11 and 12, which also affects the amount of overlap between the two ovoid areas. The adjustments to the containment areas of the left and right stride path geometries are completely independent of each other.

Figure 5A:
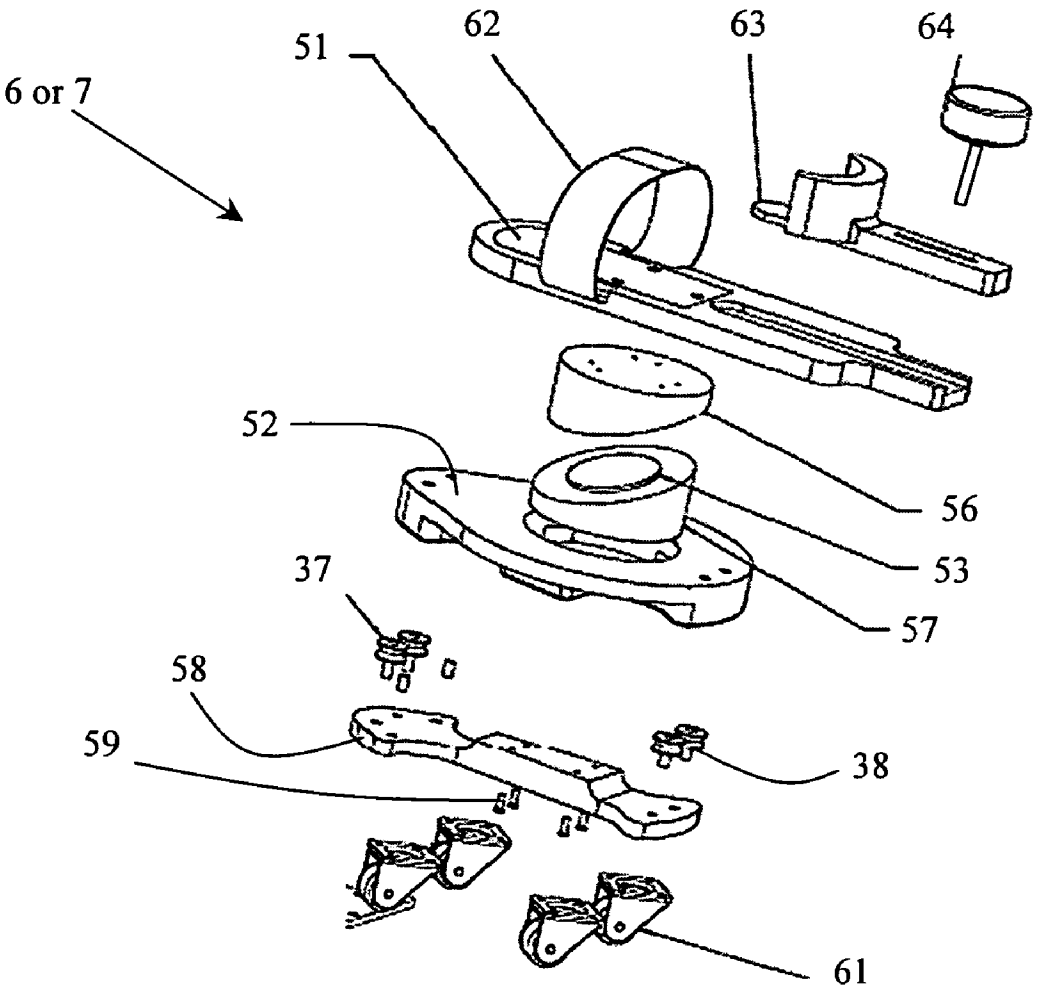
FIG. 5*a* is an exploded view of the left foot support structure of the device of FIG. 1.

With reference to FIG. 5*a*, the left and right foot supports 6 and 7, each comprise an upper foot receiving structure 51 rotatably mounted on a lower base 52 by bearing 53. The rotation of the upper foot receiving structure about a generally vertical axis enables the user's feet and ankles to turn relative to the forward direction, as in a real skating stride, while keeping the lower base 52 pointing generally frontward. A ball and socket joint or some other form of universal joint may be used to provide rotation of the upper foot receiving structure 51 relative to the lower base 52; however, most of the aforementioned universal joints typically result in an unstable arrangement. In the preferred, illustrated embodiment, the bearing 53 is mounted at an acute tilt angle between first and second cylindrical sections 56 and 57, respectively, having mating surfaces formed at the tilt angle.

The preferred embodiment provides a solid, safe and wobble-free platform for feet, while enabling an ergonomically correct tilting and turning of the foot throughout the skating stride. Accordingly, when the left and right foot supports 6 and 7 are in the forward position with the upper foot receiving structure 51 in line with the lower base 52, the mating surfaces are aligned whereby the first and second cylindrical sections 56 and 57 form a perfect cylinder. However, as the upper foot receiving structure 51 is rotated about an axis at an acute angle from vertical, i.e. perpendicular to the tilt angle, the front of the upper foot receiving structure 51 tilts downward, while the back of the upper foot receiving structure 51 tilts upward, providing the user with a more realistic skating motion. As the upper foot receiving structure 51 rotates about the axis of bearing 53, the front of the upper foot receiving structure 51 tilts downwardly and to a side of a top center axis CA, while the back of the upper foot receiving structure 51 tilts upwardly and to the opposite side of the top center axis CA, exactly following the natural tilting and turning of the foot that occurs during actual skating. Accordingly, the user has a feeling of digging in and pushing forward with the upper foot receiving structure 51, while the lower base 52 remains parallel with the surface 5.

Figure 5C:
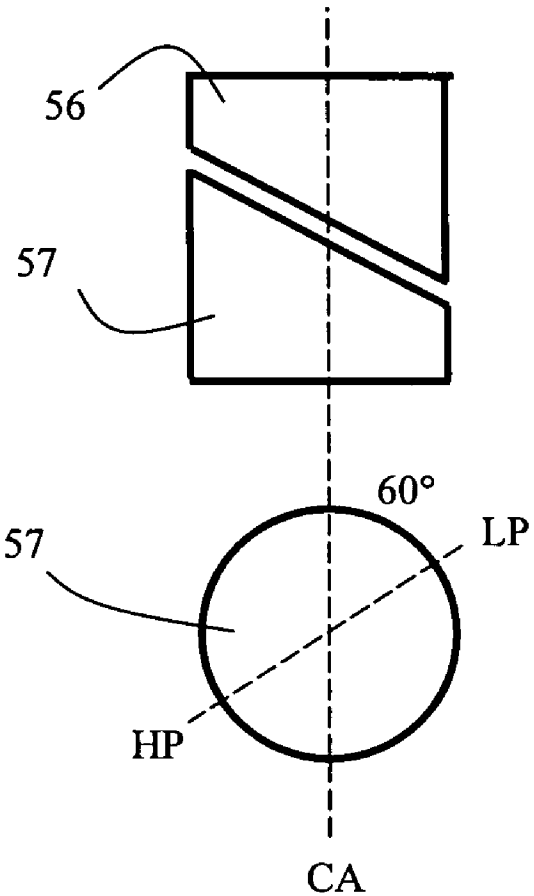
FIG. 5*c* is a side and top view of the first and second cylindrical sections of the right foot support similar to the left foot support of FIG. 5*a;*
Figure 5B:
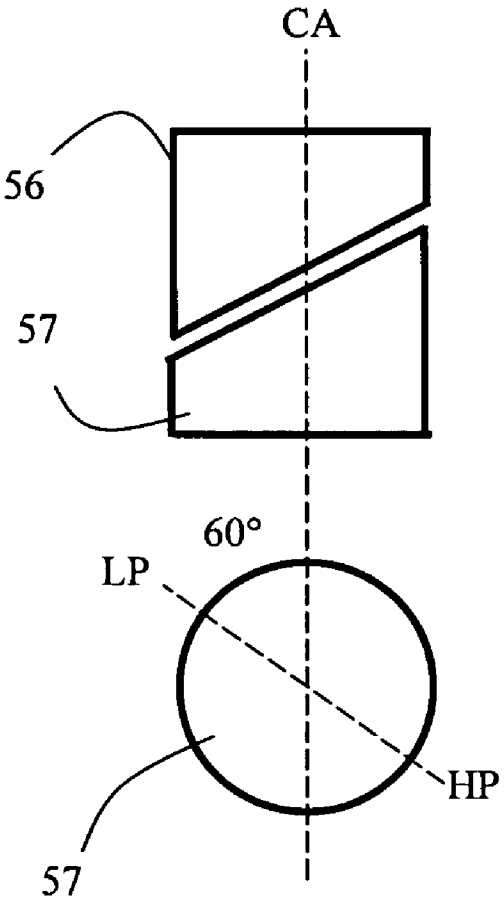
FIG. 5*b* is a side and top view of the first and second cylindrical sections of the left foot support of FIG. 5*a;*

To ensure natural movement of the feet during striding, the first and second cylindrical sections 56 and 57 of the left foot support 6 have mating surfaces, which are at an acute angle, e.g. 10° to 25°, from the horizontal, and rotated clockwise (for the right foot) or counterclockwise (for the left foot). Accordingly the lowest point LP of the mating surfaces of the first and second cylindrical section 56 and 57 of the right foot support 7 is approximately 60° clockwise from the top center axis extending from front to back (see FIG. 5*c*), while the highest point HP is diametrically opposed thereto. The lowest point LP of the mating surfaces of the first and second cylindrical sections 56 and 57 of the left foot support 6 is approximately 60° counter clockwise from the top center axis extending from front to back (see FIG. 5*b*), while the highest point HP is diametrically opposed thereto.

The front and back guide rollers 37 and 38 are mounted on the lower base 52 utilizing a mounting bracket 58 and screw fasteners 59. Castor wheels 61, or some other suitable low friction gliding apparatus, are mounted on the lower base 52. The upper foot receiving structure 51 can be any suitable structure; however, the illustrated embodiment includes a foot strap 62 and a heel receiving bracket 63, made adjustable by a threaded rod 64 extending through a slot in the heel receiving bracket 63 into the upper foot receiving structure 51. Since the castor wheels 61 always remain on the smooth surface, the skating simulation exercising device 1 provides a non-impact workout.

Figure 5D:
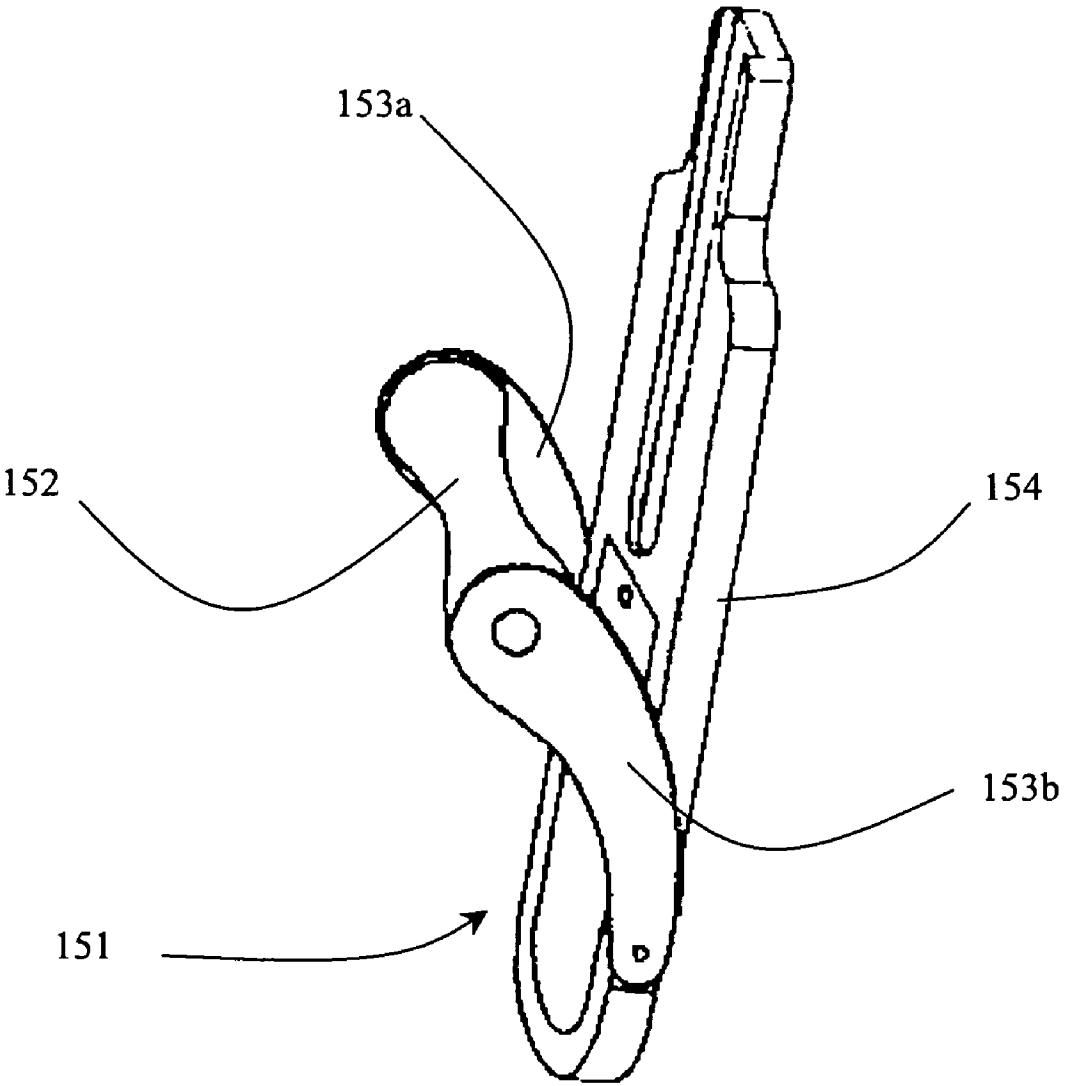
FIG. 5*d* is an isometric view of an alternative foot receiving structure of the device of FIG. 1.

In an alternate embodiment, illustrated in FIG. 5*d*, the upper foot receiving structure 51 is replaced with a more ergonomic upper foot receiving structure 151, including a foot roller 152 mounted between ends of torsional spring arms 153*a* and 153*b* extending from platform 154. The spring arms 153*a* and 153*b* bias the foot roller 152 into contact with the user's foot providing easy initial engagement, while enabling the foot to automatically disengage from the upper foot receiving structure 151, if a loss of balance should occur.

Adjustment of the heel receiving bracket 63 enables the foot of the user to be positioned such that the axis of rotation of the user's foot is in alignment with the axis of rotation of the upper foot receiving structure 151.

Figure 6:
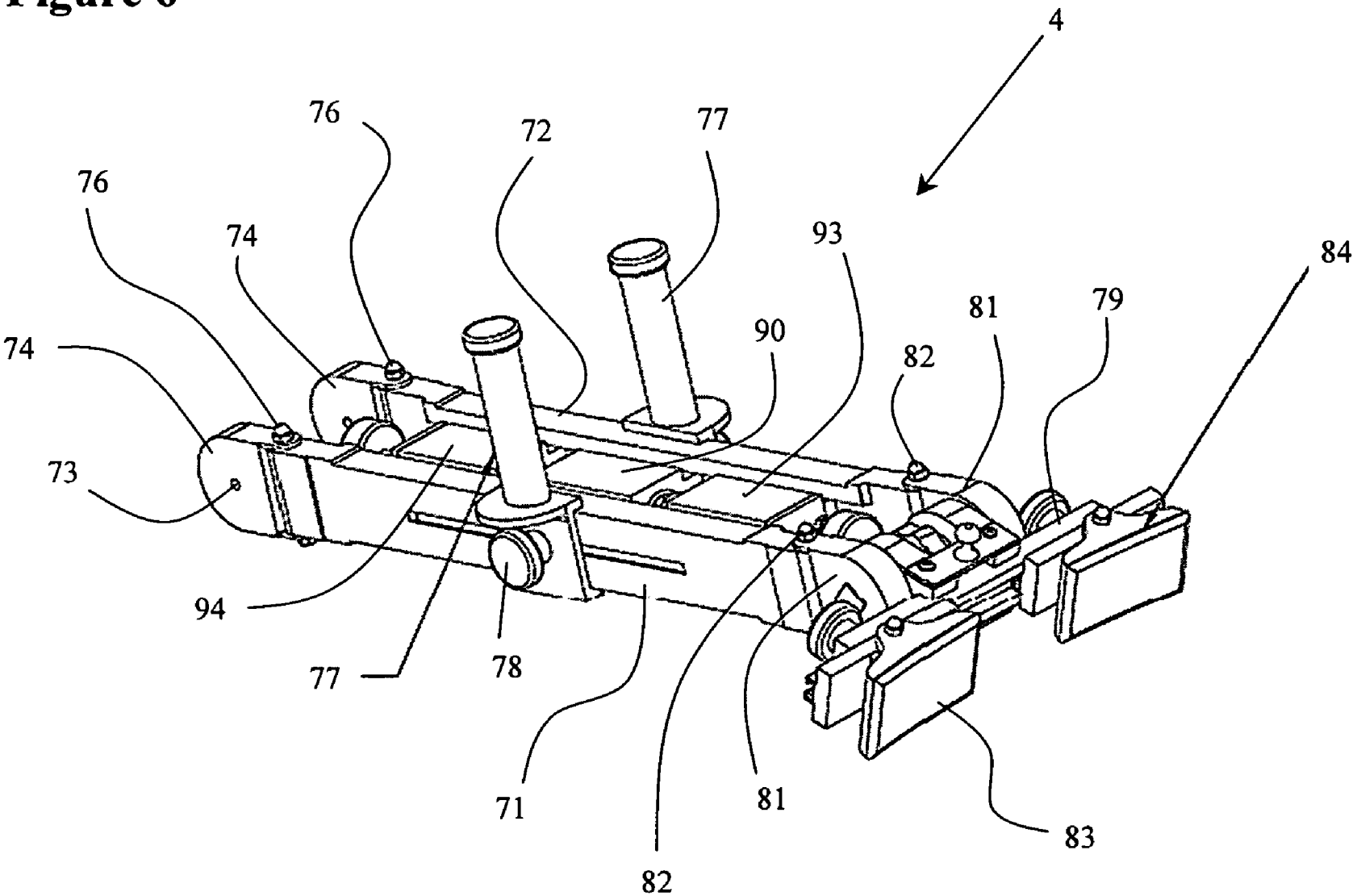
FIG. 6 is an isometric view of the torso-supporting arm of the device of FIG. 1.
Figure 7:
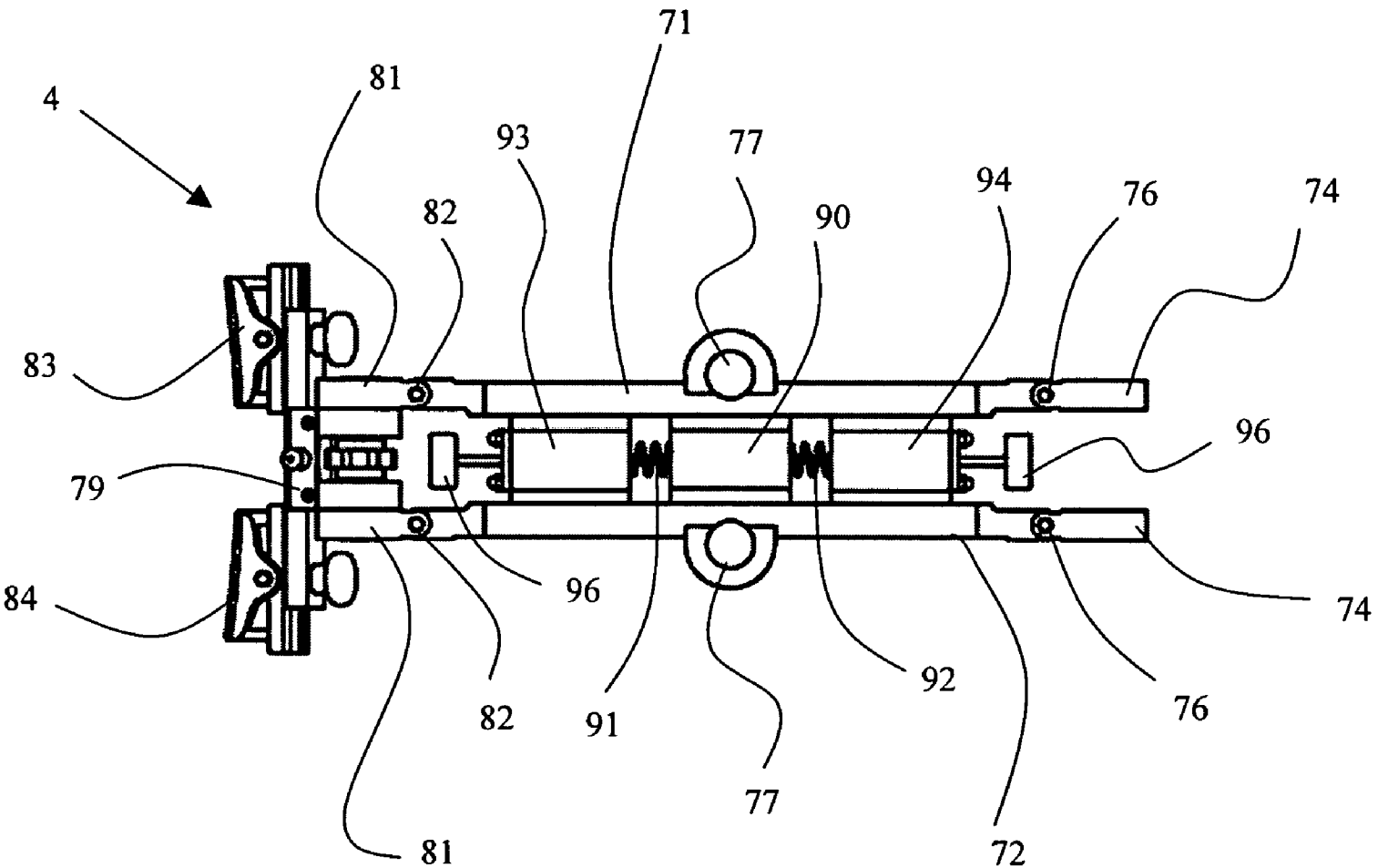
FIG. 7 is a top view of the torso-supporting arm of FIG. 5.

As illustrated in FIGS. 6 and 7, the torso-supporting arm 4 extends outwardly from the frame 2 into contact with the user's chest area, thereby supporting the user and enabling the user's upper body to freely move in concert with their lower body as the user's weight transfers from one leg to the other during the skating stride, furthering the accurate replication of body movement experienced during actual skating. The torso-supporting arm 4 includes left and right braces 71 and 72 pivotally mounted to the frame 2 about a horizontal axis defined by holes 73 extending horizontally through left and right rear brackets 74 at the ends of the left and right braces 71 and 72, enabling the torso-supporting arm 4 to be rotated down into alignment with the front leg of the frame 2 when not in use or if the user prefers not to use it. The rear brackets 74 are pivotally connected to the left and right braces 71 and 72 about a generally vertical axis defined by pins 76, enabling the torso-supporting arm 4 to rotate from side to side about the generally vertical axis, thereby following the user's side to side movement during use. Adjustable handle grips 77 are reciprocatable in slots in the left and right braces 71 and 72, respectively, and secured thereto with threaded fasteners 78.

An adjustable chest engaging padding guide 79 is pivotally mounted on the ends of the left and right braces 71 and 72 about horizontal axes via front brackets 81, which are pivotally mounted on the ends of the left and right braces 71 and 72 about a vertical axis defined by pins 82. The front and rear brackets 74 and 81, respectively, enable the left and right braces 71 and 72, respectively, to remain parallel, while the frame 2 and the padding guide 79 remain generally parallel to the user's shoulder, while the user moves side to side during use. Left and right chest pads 83 and 84 are also pivotally connected about a vertical axis to the padding guide 79, providing additional adjustment for engaging the upper body of the user.

To provide the torso-supporting arm 4 with a resistance to rotation about the vertical axis to ensure a gradual increase in resistance before reaching a hard stop, a center block 90 is mounted between the left and right braces 71 and 72, with front and rear springs 91 and 92 extending from either end thereof into contact with front and rear sliding blocks 93 and 94. The center block 90 is fixed to a first one of the left and right braces 71 and 72 and slide freely in a groove in second one, while the front and rear sliding blocks 93 and 94 are fixed to the second one of the left and right braces 71 and 72 and slide freely in a groove in the first one. Accordingly, as the user moves to one side the front spring 91 contracts, while the rear spring 92 expands, and as the user move to the other side the front spring 91 expands, while the rear spring 92 contracts. The gradual increase in resistance before reaching the stopping point ensures that the user maintain their balance during a stride, and that the user does not reach an abrupt stop at either end of the range of motion of the torso-supporting arm 4. The torso-supporting arm 4 provides an inherent element of safety. Not only do the blocks 90, 93 and 94, in combination with springs 91 and 92, ensure that the user's side to side movement is kept within a safe range, but should either spring 91 and 92 fail, the blocks 90, 93 and 94 will act as safety stops to arrest the user's sideways movement before loss of balance occurs. Adjusting knobs 96 can be used to adjust the preload on the front and rear springs 93 and 94.

I claim:

1. A skating simulating exercise device comprising:

a frame;

an inertial resistance apparatus supported by the frame;

first and second moveable foot supports for supporting a user's feet during forward, rearward and lateral movement providing variable stride path geometry with directional freedom of movement therefor;

first and second pull cables fixed at first ends thereof to the first and second moveable foot supports, respectively, and to the frame at second ends; and first and second force transmission apparatuses interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus, while exponentially increasing the amount of force transmitted to the frame during exercise; and first and second guide cables extending from behind the user, through the first and second foot supports, respectively, to the frame, thereby providing resistance to lateral motion of the first and second foot supports.

2. The device according to claim 1, wherein the first force transmission apparatus comprises:

a fixed roller over which the first pull cable travels; and a reciprocating pulley over which the first pull cable travels between the fixed roller and the second end of the first pull cable, the reciprocating pulley being out of alignment with the fixed roller and a fixed point at or proximate the second end of the first pull cable, whereby the fixed roller, the reciprocating pulley and the fixed point form a triangular arrangement, whereby pulling on the first pull cable via rearward motion of the first foot support causes the reciprocating pulley to move towards alignment with the fixed roller and the fixed point of the first pull cable, thereby exponentially decreasing the amount of force on the reciprocating pulley and exponentially increasing the resistance to rearward movement by exponentially increasing the amount of force transmitted to the frame.

3. The device according to claim 2, wherein the resistance apparatus includes a flywheel; and wherein the device further comprises first and second force transferring means for converting the motion of the reciprocating pulley into rotational motion of the flywheel.

4. The device according to claim 2, further comprising first and second mechanical linkages for interconnecting the first and second guide cables to the first and second force transmission apparatuses, respectively, whereby lateral motion of the first or second foot supports creates a pulling force on the first or second guide cable whereby the pulling force is at least partially translated to the first or second pull cable via the first or second mechanical linkage, thereby causing the reciprocating pulley to move towards alignment with the fixed roller and the fixed point of the first or second pull cable.

5. The device according to claim 4, wherein the first mechanical linkage include a lever arm connected to the first guide cable for applying force to the first pull cable, whereby when the first foot support applies a lateral force to the first guide cable, the lever arm is rotated applying force to the first pull cable, thereby moving the reciprocating pulley towards alignment with the fixed roller and fixed point of the first pull cable.

6. The device according to claim 5, wherein the first mechanical linkage further includes a pull arm one end of which is connected to the lever arm, and the other end of which includes a pulley over which the first guide cable passes; and wherein the first guide cable is fixed to the frame.

7. The device according to claim 6, wherein the first guide cable is fixed to the frame via an adjustable connector, whereby the length of the first guide cable is adjustable to accommodate a user's skating stride.

8. The device according to claim 6, wherein the pull arm is connected to the lever arm at a point, whereby force on the first guide cable is multiplied to be a force on the guide cable.

9. The device according to claim 6, wherein the fixed roller is mounted on the lever arm.

10. A skating simulating exercise device comprising:

a frame;

an inertial resistance apparatus including a flywheel supported by the frame;

first and second moveable foot supports for supporting a user's feet during forward, rearward and lateral movement providing variable stride path geometry with directional freedom of movement therefor;

first and second pull cables fixed at first ends thereof to the first and second moveable foot supports, respectively, and to the frame at second ends;

first and second force transmission apparatuses interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus, while exponentially increasing the amount of force transmitted to the frame during exercise, wherein the first force transmission apparatus comprises:

a fixed roller over which the first pull cable travels;

a reciprocating pulley over which the first pull cable travels between the fixed roller and the second end of the first pull cable, the reciprocating pulley being out of alignment with the fixed roller and a fixed point at or proximate the second end of the first pull cable, whereby the fixed roller, the reciprocating pulley and the fixed point form a triangular arrangement, whereby pulling on the first pull cable via rearward motion of the first foot support causes the reciprocating pulley to move towards alignment with the fixed roller and the fixed point of the first pull cable, thereby exponentially decreasing the amount of force on the reciprocating pulley and exponentially increasing the resistance to rearward movement by exponentially increasing the amount of force transmitted to the frame;

first and second force transferring means for converting the motion of the reciprocating pulley into rotational motion of the flywheel;

wherein the first force transferring means comprises a chain extending from the reciprocating pulley over a sprocket linked to the flywheel via a roller clutch.

11. The device according to claim 10, further comprising a spring for biasing the reciprocating pulley out of alignment with the fixed roller and the fixed point of the first pull cable.

12. The device according to claim 10, further comprising first and second guide cables extending from behind the user, through the first and second foot supports, respectively, to the frame, thereby providing resistance to lateral motion of the first and second foot supports.

13. The device according to claim 1, wherein the first and second pull cables, and the first and second guide cables define boundaries for the first and second foot supports; and wherein each boundary is approximately ovoid in shape.

14. The device according to claim 1, wherein the first and second guide cables are linked to the first and second force transmission apparatuses, respectively, whereby the resistance apparatus also has an exponentially increasing resistance to lateral movement of the first and second foot supports by exponentially decreasing the amount of force transmitted to the resistance apparatus, while exponentially increasing the amount of force transmitted to the frame.

15. A skating simulating exercise device comprising:

a frame;

an inertial resistance apparatus supported by the frame;

first and second moveable foot supports for supporting a user's feet during forward, rearward and lateral movement providing variable stride path geometry with directional freedom of movement therefor;

first and second pull cables fixed at first ends thereof to the first and second moveable foot supports, respectively, and to the frame at second ends; and first and second force transmission apparatuses interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus, while exponentially increasing the amount of force transmitted to the frame during exercise;

wherein each of the first and second foot supports includes an upper foot receiving structure rotatable on a lower base structure, whereby a user's foot may rotate during a rearward stride.

16. The device according to claim 15, wherein the upper foot receiving structure and the lower base structure include mating surfaces, which are at an acute angle to horizontal, whereby during rotation of the upper foot receiving structure, a front portion of the upper foot receiving structure tilts downward and to a side relative to the lower base structure.

17. A skating simulating exercise device comprising:

a frame;

an inertial resistance apparatus supported by the frame;

first and second moveable foot supports for supporting a user's feet during forward, rearward and lateral movement providing variable stride path geometry with directional freedom of movement therefor;

first and second pull cables fixed at first ends thereof to the first and second moveable foot supports, respectively, and to the frame at second ends; and first and second force transmission apparatuses interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus during exercise, while exponentially increasing the amount of force transmitted to the frame; and an upper torso supporting arm extending from the base for supporting a user during use.

18. The device according to claim 17, wherein the upper torso supporting arm includes left and right braces extending parallel to each other from the base;

wherein the left and right braces are pivotally connected to the base about parallel substantially vertical axes;

wherein the upper torso supporting arm also includes a body engaging pad pivotally connected to the outer free ends of the left and right braces;

whereby the left and right braces pivot from side to side as a user's weight transfers from side to side during the skating stride.

19. The device according to claim 18, wherein the upper torso supporting arm also includes a spring extending between the left and right braces providing a resistive force against rotation thereof.

20. A skating simulating exercise device comprising:

a frame;

an inertial resistance apparatus supported by the frame;

first and second moveable foot supports for supporting a user's feet during forward, rearward and lateral movement providing variable stride path geometry with directional freedom of movement therefor;

first and second pull cables fixed at first ends thereof to the first and second moveable foot supports, respectively, and to the frame at second ends; and first and second force transmission apparatuses interconnecting the first and second pull cables, respectively, with the resistance apparatus, whereby the resistance apparatus has an exponentially increasing resistance to rearward movement of the first and second foot supports by exponentially decreasing the amount of force transmitted to the resistance apparatus, while exponentially increasing the amount of force transmitted to the frame during exercise;

wherein the first pull cable is connected to the frame with an adjustable connector, whereby the length of the first pull cable is adjustable to accommodate a user's skating stride.

* * * * *